United States Patent [19]

George

[11] Patent Number: 4,840,276

[45] Date of Patent: Jun. 20, 1989

[54] CONE PACKAGE

[75] Inventor: Frederick A. George, Hermitage, Pa.

[73] Assignee: George & Thomas Cone Company, Hermitage, Pa.

[21] Appl. No.: 198,439

[22] Filed: May 25, 1988

[51] Int. Cl.[4] ..... B65D 85/36

[52] U.S. Cl. ..... 206/499; 206/521; 206/564; 229/2.5 R; 426/128

[58] Field of Search ..... 206/499, 521, 525, 526, 206/587, 564, 591-594; 217/26.5, 27, 28; 229/2.5 R; 426/124, 128

[56] References Cited

U.S. PATENT DOCUMENTS

| | | | |
|---|---|---|---|
| D. 155,932 | 11/1949 | Shepard . | |
| 2,750,028 | 6/1956 | Bode et al. . | |
| 3,164,478 | 1/1965 | Bostrom | 229/2.5 R |
| 3,343,671 | 9/1967 | Weinstein . | |
| 3,400,873 | 9/1968 | Bessett . | |
| 3,835,994 | 9/1974 | Davis et al. | 206/499 |
| 4,269,316 | 5/1981 | Growney | 206/499 |
| 4,349,571 | 9/1982 | Davis et al. | 426/124 |

FOREIGN PATENT DOCUMENTS

| | | | |
|---|---|---|---|
| 0623328 | 7/1961 | Italy | 229/2.5 R |
| 0870704 | 6/1961 | United Kingdom | 229/2.5 R |

*Primary Examiner*—Jimmy G. Foster
*Attorney, Agent, or Firm*—Harpman & Harpman

[57] ABSTRACT

A package for ice cream cones or the like that are of a fragile nature and construction in which the cones are stacked in a telescopically opposed nature to one another. The package is formed of a foam material which support and suspends each cone within the stack independently holding the cones in spaced non-compressible relation to form a cushion restraint against movement and breakage during the handling and shipping of the package.

6 Claims, 2 Drawing Sheets

CONE PACKAGE

BACKGROUND OF THE INVENTION

1. Technical Field

This device relates to the packaging of fragile articles, such as ice cream cones which must be transported to remote locations for sales and distribution. The cone package attempts to hold the cones in a cushioned enclosure to prevent breakage of the cones during shipment.

2. Description of Prior Art

Prior Art devices of this type have relied on a variety of different package configurations in an attempt to protect the fragile cones from breakage, see for example U.S. Pat. Nos. Des. 155,932, 2,750,028, 3,343,671, 3,835,994, 3,400,873, 4,269,316 and 4,349,571.

In U.S. Pat. No. Des. 155,932 a package is disclosed that has a plurality of contoured recesses within to hold an article in a cushioning protective manner.

U.S. Pat. No. 2,750,028 discloses a separator for use in packaging of amunition cartridges in which a two-part multiple container separator is folded over to separate and cushion the cartridges from engagement with one another.

U.S. Pat. No. 3,343,671 shows a container for fragile articles that uses a cardboard box having multiple spaced loops extending inwardly from its sides to support vertical columns of nested ice cream cones in spaced relation.

In U.S. Pat. No. 3,835,994 a cone package is disclosed that has a pair of foam panels with corresponding pockets within that are folded over on top of one another to hold a sack of nested cones in the registering pockets. The pockets are featureless elongated recesses with a plurality of raised ribs positioned along the top of a common partition between the pockets.

U.S. Pat. No. 3,400,873 is directed to a molded receptacle for holding fragile articles having a pair of oppositely disposed panels each with an elongated featureless cavity within for placement of the articles.

U.S. Pat. No. 4,269,316 discloses an ice cream cone package formed of paper board to form a tray to receive stacked cones in telescopic relation suspended by a plurality of elongated spaced transverse ribs that support the cones continuously along their surface.

In U.S. Pat. No. 4,345,571 a bulk cone container is shown having a plurality of folded foam sandwich structures to form a row of cells holding within one cone stack per cell. Each foam structure engages the respective sides of the cone stack and a cell-like construction.

SUMMARY OF THE INVENTION

A package for ice cream cones for shipping and dispensing a number of cones in stacked nested telescopic relation. The package consist of a pair of hinged identical foam structures each having a pair of multiple contoured ribbed cavities to engage and hold each cone independently from longitudinal and transverse movement. Each of the ribs is contoured transversely of itself and a restrictive portion conforming to the contoured surface of the cone.

DESCRIPTION OF THE PREFERRED EMBODIMENT

Figure 1:
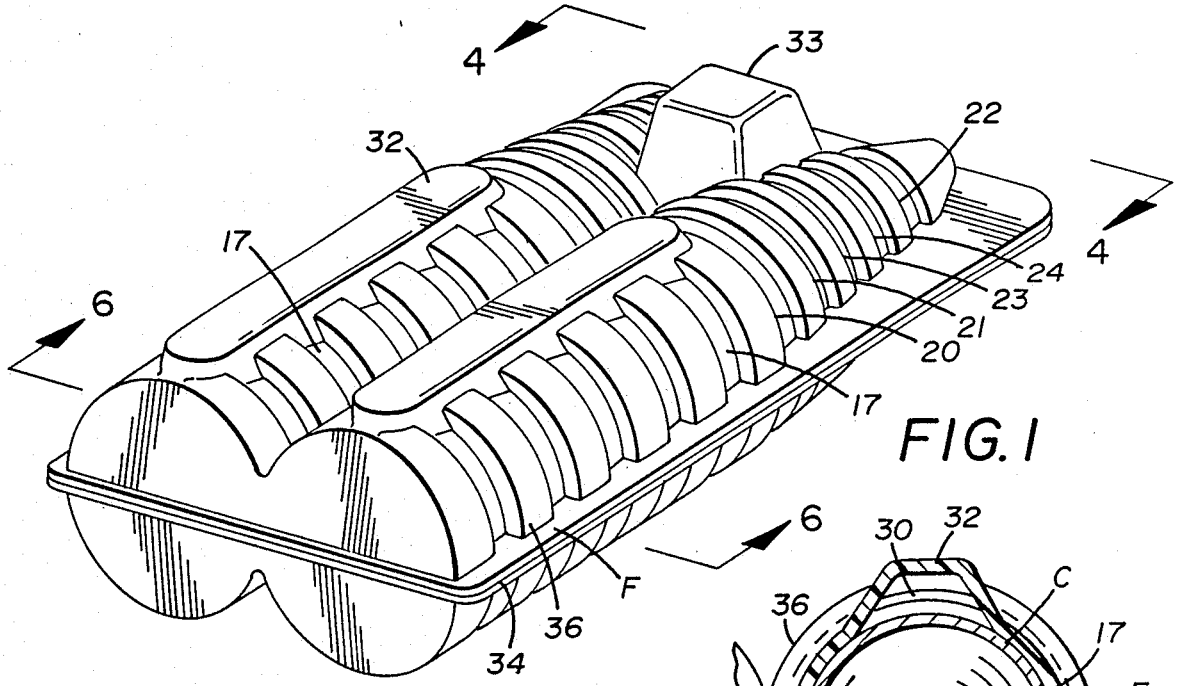
FIG. 1 is a perspective view of the foam package.
Figure 2:
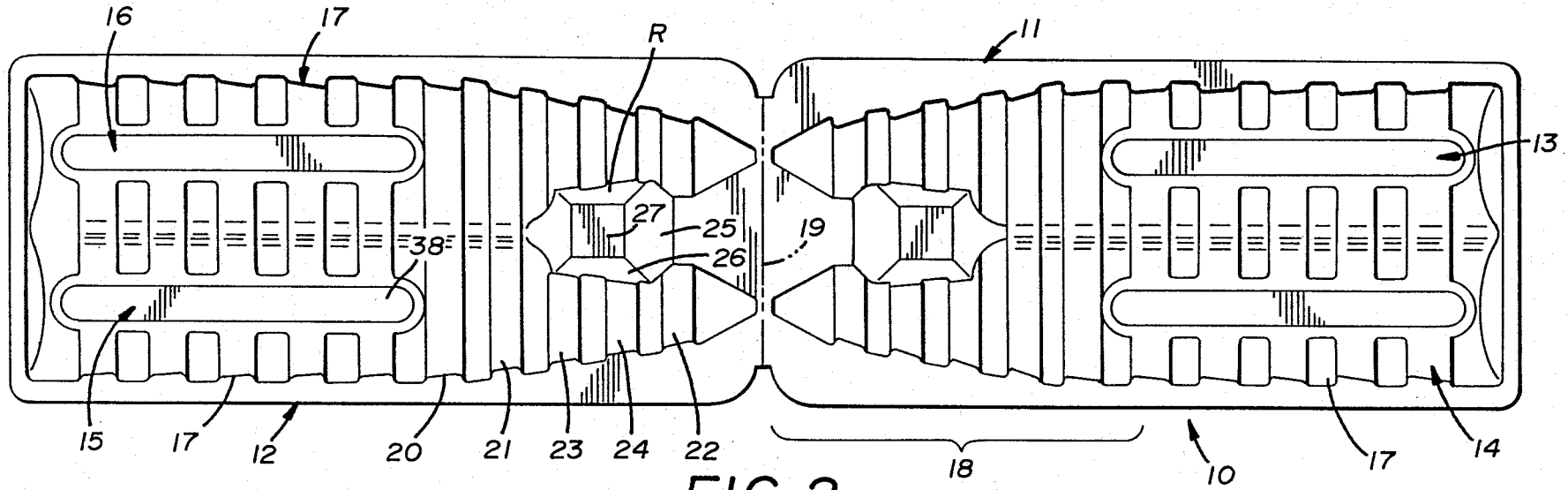
FIG. 2 is a top plan view of the foam package in open unloaded condition.
Figure 3:
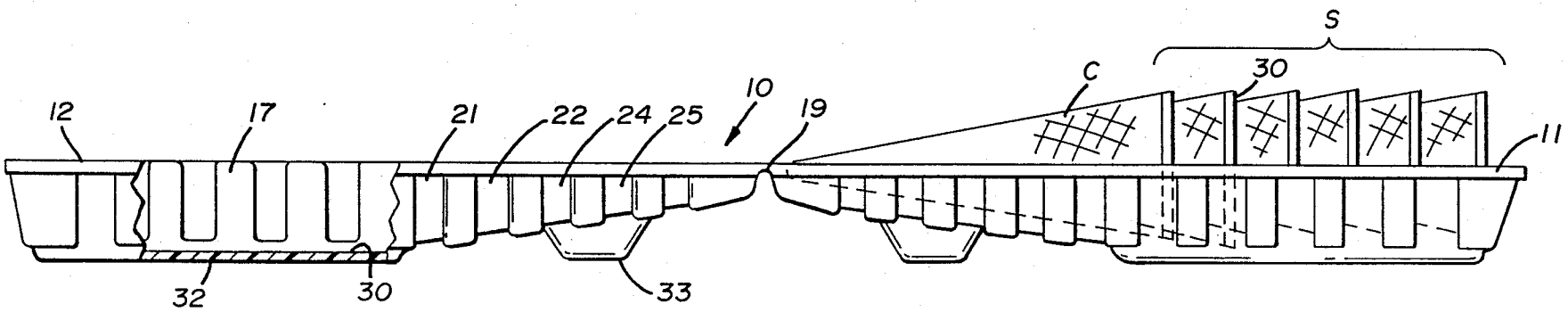
FIG. 3 is a side plan view of a portion of the foam container loaded with ice cream cones.

A package for the transportation and dispensing of ice cream cones can be seen in FIGS. 1, 2 and 3 of the drawings comprising a single panel 10 of expanded foam plastic resin material. The panel 10 is divided into two identical subpanels 11 and 12 each of which has a pair of elongated pockets 13, 14, and 15, 16 respectively within that are formed generally to denote a semi-cylindrical shape. Each of the elongated pockets 13–16 is formed by a plurality of longitudinally spaced arcuate partial ribs 17 with the pcoket diminishing in depth and transverse dimension at one end to form a half cone shaped portion 18 which abuts the corresponding panel along a hinge 19 between the panels shown in broken lines.

A series of longitudinally spaced ribs are formed within the portion 18 with ribs 20, 21, and 22 extending fully transversely across the pocket while ribs 23 and 24 extend only three-quarters of the distance across the portion 18 due to the intersection of a recessed area R having pairs of oppositely disposed tapered walls 25 and 26 and generally square flat bottom portion 27. Each of the elongated pockets 13 through 16 has a corresponding elongated recessed area 28 that intersects the respective multiple ribs 17, best seen in FIGS. 2 and 5 of the drawings.

Figure 6:
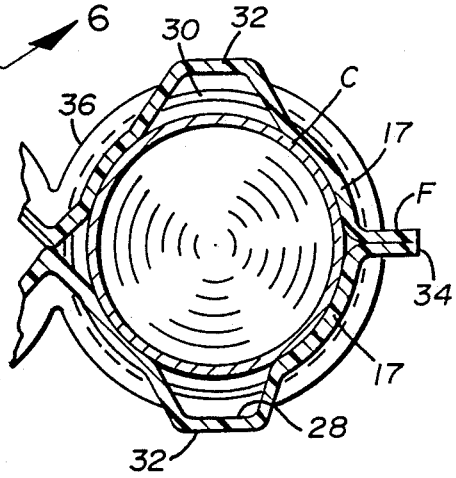
FIG. 6 is a partial cross-sectional view on lines 6—6 of FIG. 1.
Figure 4:
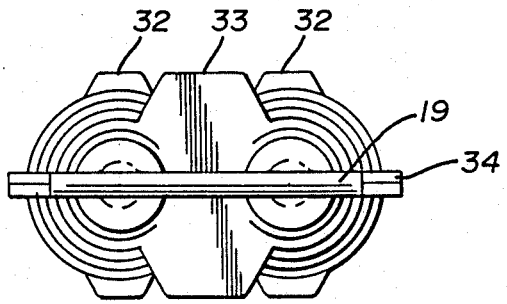
FIG. 4 is an end plan view on lines 4-4 of FIG. 1.
Figure 5:
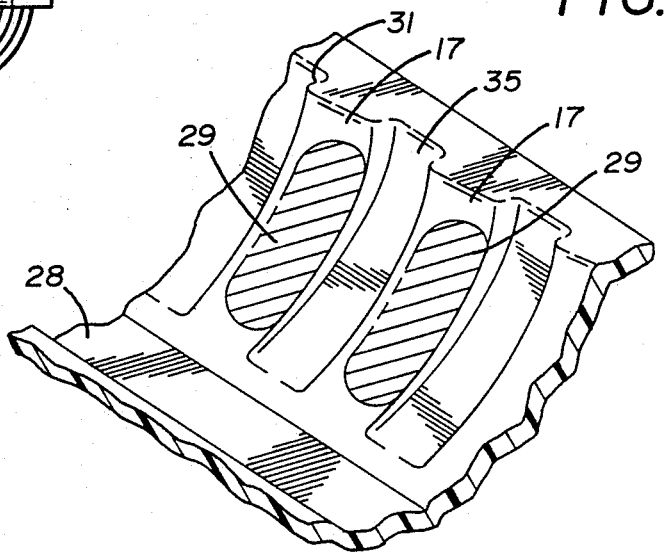
FIG. 5 is an enlarged portion of the interior side showing the compound, concave formation of the transversely angled ribs.

Referring now to FIGS. 2, 3, 5 and 6 of the drawings each of the ribs 17 and 21 through 24 have a transversely angularly disposed surface with an area of indentation at 29 indicated in FIGS. 3 and 5 by diagonal lines (which have been emphasized for illustration purposes only). It will be recognized that when ice cream cones C are nested in a stack S and positioned within the pockets 13 through 16 that the cones S conical shape of its exterior surface will be matched and supported by pairs of oppositely disposed arcuate ribs 17 and the areas of indentation at 29 which when the panels 11 and 12 are foled over on the hinge 19 will provide support for over 75% of the cones exterior surface within the area defined by the ribs, as best seen in FIG. 6 of the drawings. Additionally, each of the cones C has a free annular edge 30 which will engage and edge 31 of each rib 17 opposite said area of indentation at 29 which in combination with the hereinbefore described rib configuration prevents longitudinal movement of the cones C. Since each of the cones C are positioned and supported independently by the corresponding rib, annular spacing is achieved between the exterior surface of the cone C and the next nested cone's annular edge 30 which is most clearly seen in FIG. 6 of the drawings just below the elongated recessed area 28.

Referring now to FIG. 1 of the drawings the recessed areas R and 28 form upstanding support ribs 32 and pad 33 which when viewed from their opposite side provides for multiple space support elements of the complete package when closed over 2 stack S of cones C within. The panels 11 and 12 as described above are preferrably formed as a unitary structure by thermoforming foam sheet material. After formation, the panels 11 and 12 are trimmed leaving a frame F along each side and one end of the package so that when the two adjacent panels 11 and 12 are folded over in face to fact relation as hereinbefore described the frame F will extend therearound defining a uniform rectangular edge 34 which will act as a spacing support element when the package is inserted into a shipping box (not shown) of a registering dimension.

Referring back to FIGS. 1, 3 and 5 of the drawings the areas between the ribs 17 and 21 thorugh 26 form recess areas 35 of equal thickness with flat surface and are of even arcuate surface configuration. This can be seen in FIG. 1 of the drawings wherein the recess 35 forms a reverse rib 36 having no transverse angular inclination whatsoever evident by the intersection of same with the frame F as hereinbefore described. Even though the cone C are gripped over 75% of their surface within the area defined by the ribs 17 crushing of the cones will not take place upon compression of the packages outer surface since such compression will engage the reversed ribs 36 which are in reality the recessed areas 35 between the supporting ribs 17.

End walls 37 and 38 in each of the panels 11 and 12 are angularly inclined away from the respective ribs 17 so that when the panels 11 and 12 are folded over one another in face to face relation to form the package around the cone C they will be abutting end walls edges 34 which will reenforce themselves and provide ample spacing in relation to the cones within protecting same from an impact.

Thus, it will be seen that a new and useful cone package has been illustrated and described and that various changes and modifications may be made therein without departing from the spirit of the invention, therefore I claim:

I claim:

1. An ice cream cone package for holding a number of nested cones therein comprises a pair of identical generally rectangular panels made of a resilient plastic resin material, said panels joined together in hinged relationship at identical ends, a plurality of elongated pockets in each of said panels, said pockets facing one another when said panels are folded in face to face relationship, a plurality of longitudinally spaced arcuate ribs throughout each of said pockets separated by arcuate recesses having flat surfaces, an elongated recessed area formed in each of said pockets inwardly of said identical ends, substantially square recessed areas positioned between and intersecting portions of said, pockets adjacent said identical ends, each of said ribs having a transversely angularly disposed surface in relation to said flat surfaces of said arcuate recesses and an additional area of greater transverse angularly indentations in relation to said flat surfaces of said arcuate recesses, some of said arcuate recessed areas interconnecting to adjoining arcuate recessed areas of an adjacent pocket.

2. The ice cream cone package of claim 1 wherein said each of said pockets diminish in depth and transverse dimension at one end, some of said ribs extend completely across said area of diminished depth and transverse dimension.

3. The ice cream cone package of claim 1 wherein said recessed area formed in the bottom of each of said pockets intersects some of said arcuate ribs diminishing same into a longitudinally extending spaced parallel surface defining said recessed area.

4. The ice cream cone package of claim 1 wherein said elongated recessed areas and said substantially square recessed areas defined in the reverse, upstanding support pads and ribs respectively providing package support.

5. The ice cream cone package of claim 1 wherein said additional area of greater angular indentation is limited to said ribs adjacent said elongated recessed areas in each of said pockets.

6. The ice cream cone package of claim 1 wherein said additional area of greater angular indentation on each of said ribs is of an equal area and is inclined towards said free ends of said rectangular panels respectively.

* * * * *